US009161632B1

(12) United States Patent
Tomaini

(10) Patent No.: US 9,161,632 B1
(45) Date of Patent: Oct. 20, 2015

(54) FOOT PILLOW

(71) Applicant: Delfina Tomaini, Jacksonville, FL (US)

(72) Inventor: Delfina Tomaini, Jacksonville, FL (US)

( * ) Notice: Subject to any disclaimer, the term of this patent is extended or adjusted under 35 U.S.C. 154(b) by 0 days.

(21) Appl. No.: 14/645,921

(22) Filed: Mar. 12, 2015

(51) Int. Cl.
*A47C 20/02* (2006.01)
*A47C 20/00* (2006.01)
*A47C 7/52* (2006.01)
*A47C 21/02* (2006.01)

(52) U.S. Cl.
CPC ..... *A47C 20/021* (2013.01); *A47C 7/52* (2013.01); *A47C 21/024* (2013.01)

(58) Field of Classification Search
CPC ..... A47C 20/021; A47C 21/024
USPC ..... 5/630, 632, 648, 650, 651, 505.1
See application file for complete search history.

(56) References Cited

U.S. PATENT DOCUMENTS 3,803,645 A * 4/1974 Oliverius ..... 5/650
4,941,222 A * 7/1990 Prager ..... 5/111
5,175,899 A * 1/1993 Lou ..... 5/505.1
5,237,713 A * 8/1993 Prager ..... 5/722
5,740,571 A * 4/1998 Tyra ..... 5/624
5,745,939 A 5/1998 Flick et al.
6,668,401 B2 12/2003 Waters
6,754,921 B2 * 6/2004 Gill-Barajas ..... 5/425
6,935,697 B2 8/2005 Conlon et al.
2005/0060808 A1 * 3/2005 Shaw ..... 5/649
2013/0167297 A1 * 7/2013 Kaminski, Jr. ..... 5/498

* cited by examiner

*Primary Examiner* — Michael Trettel
(74) *Attorney, Agent, or Firm* — Crossley Patent Law

(57) ABSTRACT

A foot pillow including at least one cushion having a top side, a flat bottom side a right side and a left side. The flat bottom of the at least one cushion prevents the at least one cushion from rolling. A cover having an outer wall and a right side and a left side is provided. The at least one cushion is removably insertable through each of the right side and the left side of the cover. An elastomeric strap having a right end and a left end is provided and attached to the cover. The strap wraps around the perimeter of a foot rest item such as a foot end of a mattress or a recliner foot rest, securing the foot pillow in place.

10 Claims, 4 Drawing Sheets

FOOT PILLOW

BACKGROUND OF THE INVENTION

Various types of foot pillows are known in the prior art. However, what is needed is a foot pillow including a removable at least one cushion, a cover, and an elastomeric strap that wraps around the perimeter of a foot rest item such as a foot end of a mattress or a recliner foot rest, securing the foot pillow in place. People suffer from many ailments pertaining to their feet. Some of these ailments include pain in the ball of the foot, heel pain such as plantar fasciitis, bunions, bone spurs, tendonitis, stress fractures, hammertoes, gout and arthritis in the feet, ankles and or toes. Many people also suffer from tired legs and feet during pregnancy or after standing for extended periods of time. At times, people are bedridden and may develop bedsores. The foot pillow is designed to help relief the listed ailments along with many others not listed.

FIELD OF THE INVENTION

The present invention relates to foot pillow, and more particularly, to a foot pillow with a removable at least one cushion, a cover and an elastomeric strap.

SUMMARY OF THE INVENTION

The general purpose of the present foot pillow, described subsequently in greater detail, is to provide a foot pillow which has many novel features that result in a foot pillow which is not anticipated, rendered obvious, suggested, or even implied by prior art, either alone or in combination thereof.

To accomplish this, the present foot pillow includes at least one hemispherical cushion having a top side, a flat bottom side, a right side, and a left side. The flat bottom side allows the at least one cushion to lie flat and prevents unwanted movement and rolling of the cushion A cover with a continuous outer wall, a right end, and a left end, is configured to receive the at least one cushion therein. The cover has a length and a width substantially equal to a length and a width of the cushion. The at least one cushion is removably insertable within the cover. The removability of the at least one cushion allows for multiple options of a user. The at least one cushion is removable to allow the user to decide when the cushion is necessary without removing the entire foot pillow when the foot pillow is not needed.

An elastomeric strap with a first end and a second end. The first end is attached to the right end and the second end is attached to the left end. The strap removably and continuously engages a perimeter of a foot rest item. The strap and the cover have a combined length configured to engage the perimeter. The elasticity of the strap provides engagement and disengagement to the perimeter of the foot rest item. The elasticity also provides a secure fit around the foot rest item.

The foot rest item is one of a foot end of a mattress and a recliner foot rest. The strap has a width in a range of approximately twelve inches to fifteen inches. The width of the strap provides the necessary support of the strap when engaged around a footrest item and prevents rolling and breakage of the strap. The cushion has a height in a range of approximately one inch to fifteen inches. The height of the cushion allows for the relief of a multitude of ailments of the user.

Thus has been broadly outlined the more important features of the present foot pillow so that the detailed description thereof that follows may be better understood and in order that the present contribution to the art may be better appreciated.

BRIEF DESCRIPTION OF THE DRAWINGS FIGURES

DETAILED DESCRIPTION OF THE DRAWINGS

Figure 1:
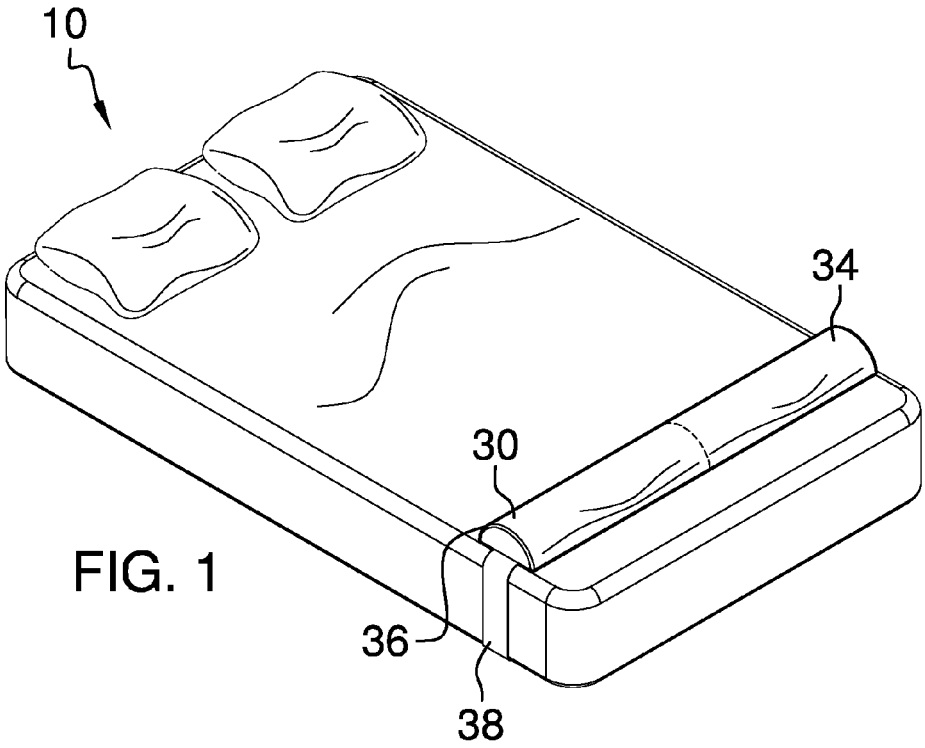
FIG. 1 is an in-use isometric view.
Figure 2:
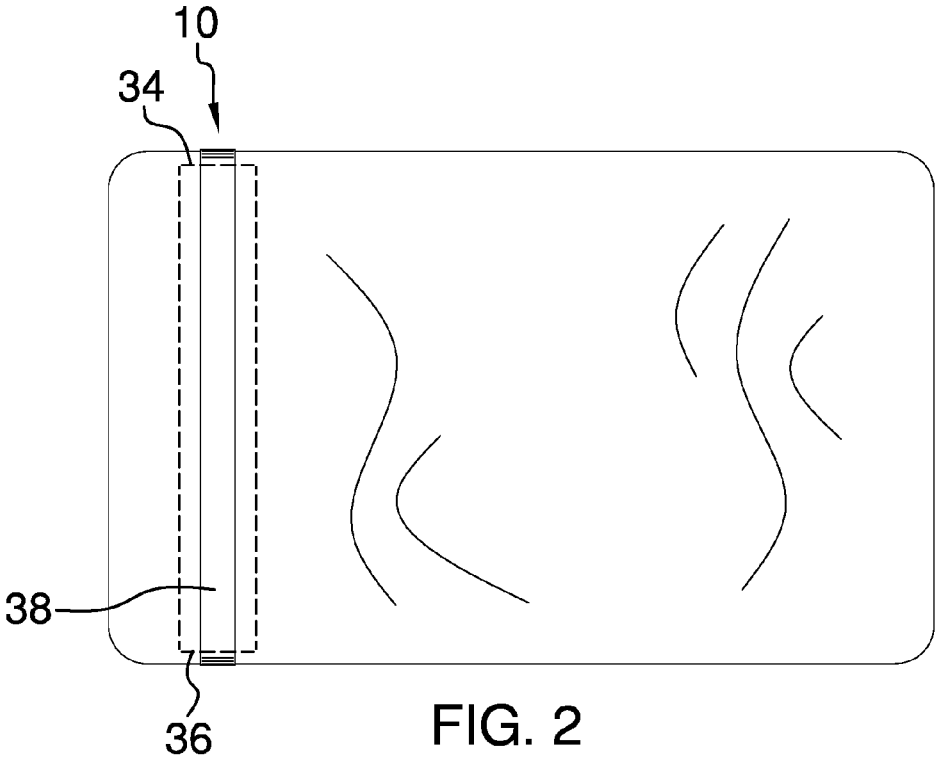
FIG. 2 is an in-use bottom plan view.
Figure 3:
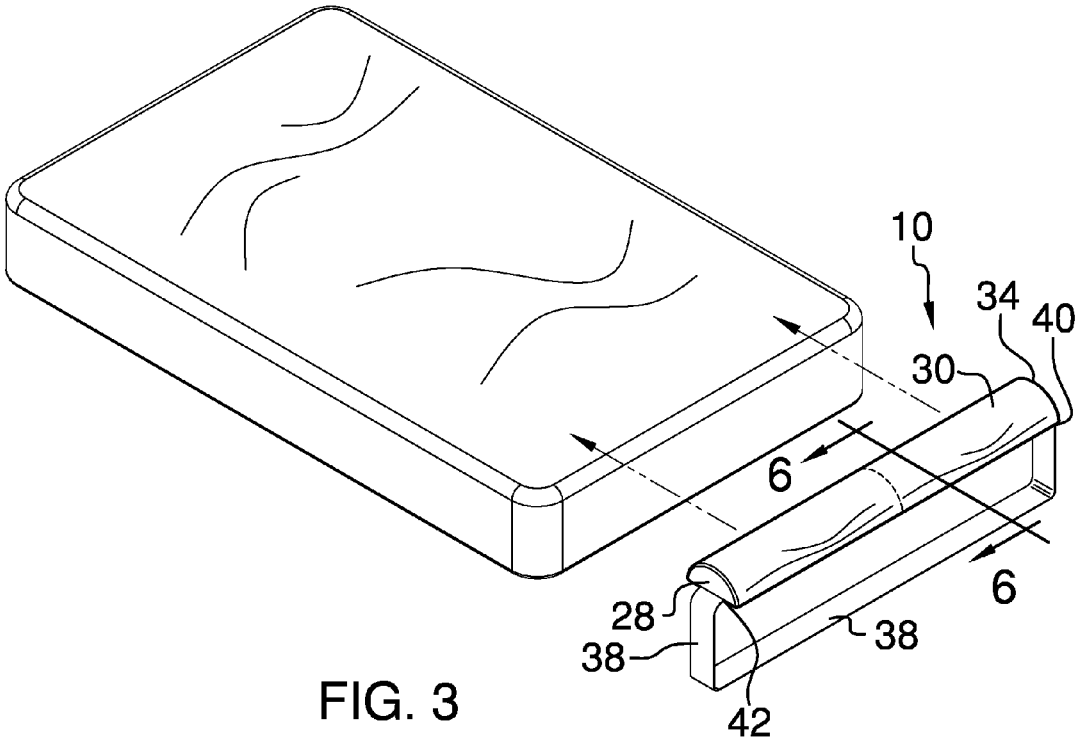
FIG. 3 is an in-use exploded isometric view showing the attachability of a foot pillow to a foot end of a mattress.
Figure 4:
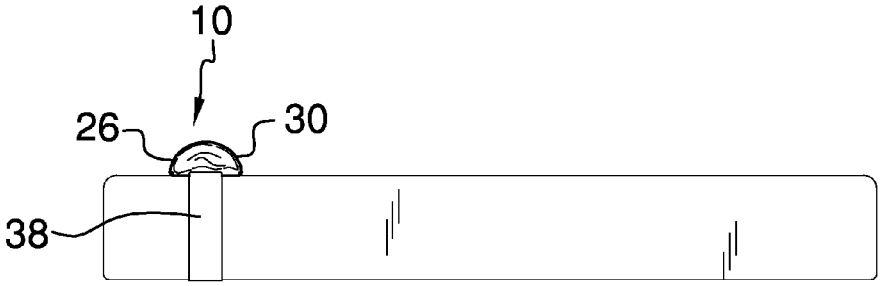
FIG. 4 is a side elevation view.
Figure 5:
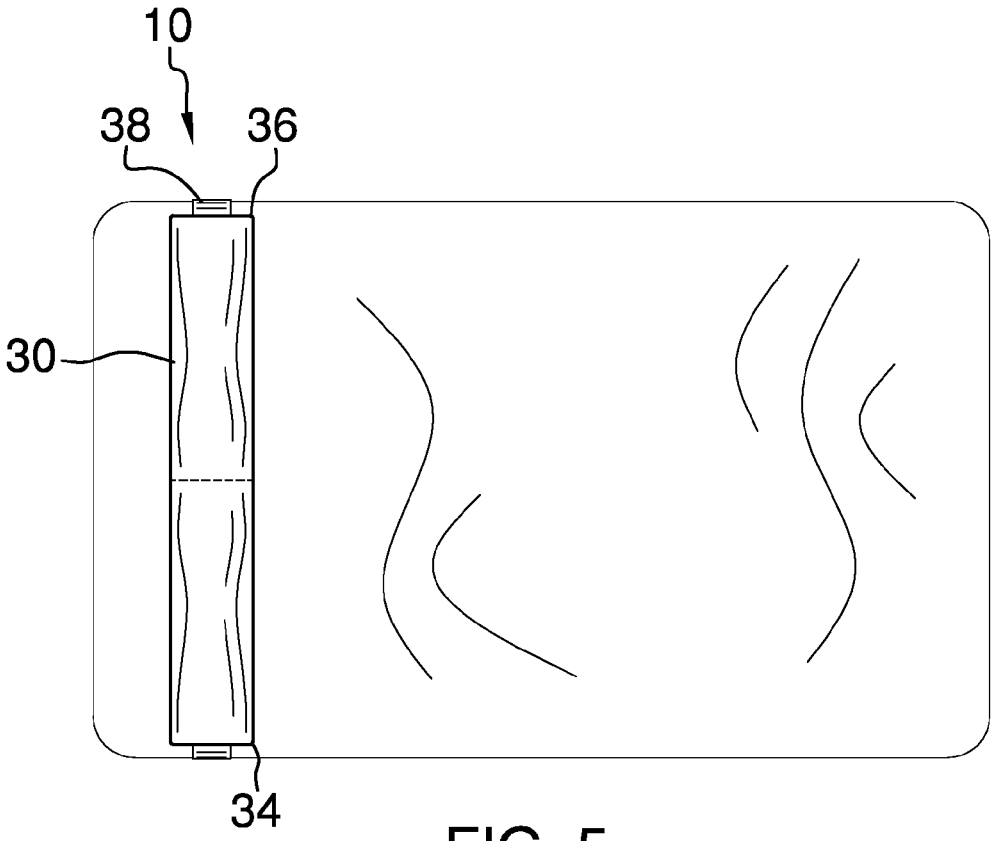
FIG. 5 is a top elevation view
Figure 6:
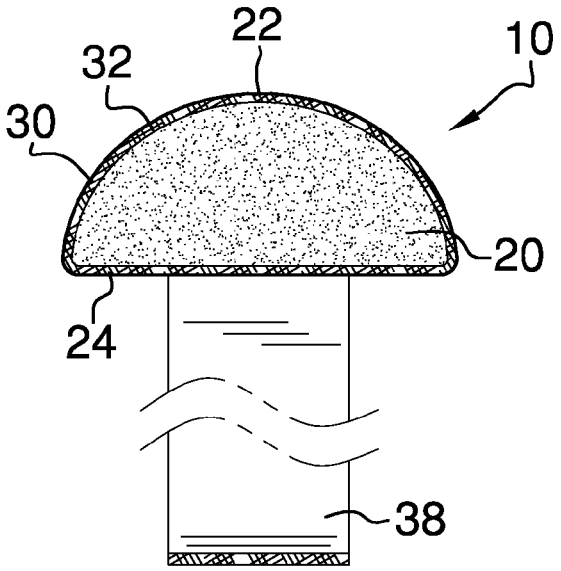
FIG. 6 is a cross-sectional view taken along line 6-6 of FIG. 3.
Figure 7:
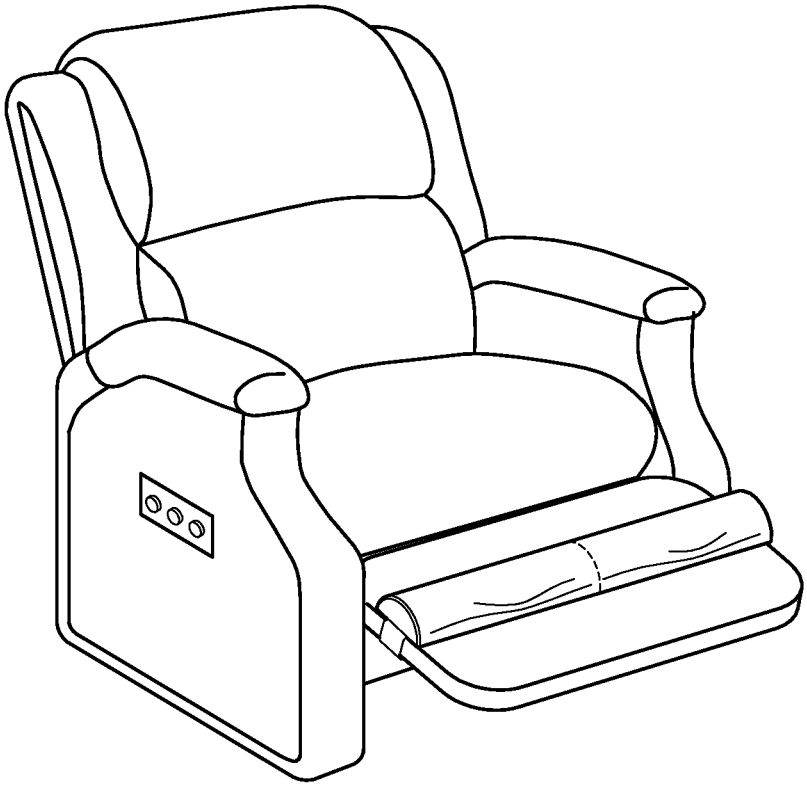
FIG. 7 is an in-use isometric view showing the foot pillow attached to a recliner foot rest.

With reference now to the drawings, and in particular FIGS. 1 through 7 thereof, an example of the instant foot pillow employing the principles and concepts of the present foot pillow and generally designated by the reference number 10 will be described.

Referring to FIGS. 1 through 7 the present foot pillow 10 is illustrated. The foot pillow 10 includes at least one hemispherical cushion 20 having a top side 22, a flat bottom side 24, a right side 26, and a left side 28. The flat bottom side 24 allows the at least one cushion 20 to lie flat and prevents unwanted movement and rolling of the cushion.

A cover 30 with a continuous outer wall 32, a right end 34, and a left end 36, is configured to receive the at least one cushion 20 therein. The cover 30 has a length and a width substantially equal to a length and a width of the cushion 20. The at least one cushion 20 is removably insertable within the cover 30. The removability of the at least one cushion 20 allows for multiple options of a user. The at least one cushion 20 is removable to allow the user to decide when the cushion is necessary without removing the entire foot pillow 10 when the foot pillow 10 is not needed.

An elastomeric strap 38 with a first end 40 and a second end 42 opposite the first end 40 is provided. The first end 40 is attached to the right end 34 and the second end 42 is attached to the left end 36. The strap 38 removably and continuously engages a perimeter of a foot rest item. The strap 38 and the cover 30 have a combined length configured to engage a the perimeter. The elasticity of the strap 38 provides engagement and disengagement to the perimeter of the foot rest item. The elasticity also provides a secure fit around the foot rest item.

The foot rest item is one of a foot end of a mattress and a recliner foot rest. The strap 38 has a width in a range of approximately twelve inches to fifteen inches. The width of the strap 38 provides the necessary support of the strap when engaged around a footrest item and prevents rolling and breakage of the strap 38. The at least one cushion 20 has a height in a range of approximately one inch to fifteen inches. The height of the at least one cushion 20 allows for the relief of a multitude of ailments of the user.

What is claimed is:

1. A foot pillow comprising:

at least one cushion having a right side, and a left side;

a cover having a continuous outer wall, a right end, and a left end, wherein the cover has a length and a width substantially equal to a length and a width of the cushion, wherein the cover is configured to receive the at least one cushion therein; and an elastomeric strap having a first end attached to the cover right end and a second end attached to the cover left end, wherein the strap removably and continuously engages a perimeter of a foot rest item.

2. The foot pillow of claim 1 wherein the at least one cushion is hemispherical; and wherein the at least one cushion is removably insertable within the cover.

3. The foot pillow of claim 1 wherein the at least one cushion is hemispherical; and wherein the at least one cushion is removably insertable within the cover.

4. The foot pillow of claim 1 wherein the foot rest item is one of a foot end of a mattress and a recliner foot rest.

5. The foot pillow of claim 1 wherein the foot rest item is one of a foot end of a mattress and a recliner foot rest.

6. The foot pillow of claim 2 wherein the foot rest item is one of a foot end of a mattress and a recliner foot rest.

7. The foot pillow of claim 3 wherein the foot rest item is one of a foot end of a mattress and a recliner foot rest.

8. A foot pillow comprising:

at least one hemispherical cushion having a top side, a flat bottom side, a right side, and a left side;

a cover having a continuous outer wall, a right end, and a left end, wherein the cover has a length and a width substantially equal to a length and a width of the cushion, wherein the cover is configured to receive the at least one cushion therein; and an elastomeric strap having a first end attached to the cover right end and a second end attached to the cover left end, wherein the strap removably and continuously engages a perimeter of a foot rest item;

wherein the at least one cushion is removably insertable within the cover; and wherein the foot rest item is one of a foot end of a mattress and a recliner foot rest.

9. The foot pillow of claim 8 wherein the strap has a width in a range of approximately twelve inches to fifteen inches.

10. The foot pillow of claim 9 wherein the cushion has a height in a range of approximately one inch to fifteen inches.

* * * * *